US005420930A

United States Patent [19]

Shugart, III

[11] Patent Number: 5,420,930

[45] Date of Patent: May 30, 1995

[54] HEARING AID DEVICE

[76] Inventor: M. Wilbert Shugart, III, P.O. Box 892, Yadkinville, N.C. 27055

[21] Appl. No.: 205,251

[22] Filed: Mar. 3, 1994

Related U.S. Application Data

[63] Continuation-in-part of Ser. No. 848,320, Mar. 9, 1992, Pat. No. 5,343,532.

[51] Int. Cl.[6] ..... H04R 25/00

[52] U.S. Cl. ..... 381/68.6; 381/68; 381/69

[58] Field of Search ..... 381/68, 68.6, 68.5, 381/69, 69.2, 68.3, 151

[56] References Cited

U.S. PATENT DOCUMENTS

| | | | |
|---|---|---|---|
| 2,485,405 | 10/1949 | Olney et al. . | |
| 3,209,081 | 9/1965 | Ducote et al. . | |
| 3,894,195 | 7/1975 | Kryter | 179/107 FD |
| 4,259,547 | 3/1981 | Valley et al. | 179/1 B |
| 4,334,315 | 6/1982 | Ono et al. | 455/11 |
| 4,340,972 | 7/1982 | Heist | 455/39 |
| 4,379,988 | 4/1983 | Mattatall | 320/4 |
| 4,472,603 | 9/1984 | Berg | 179/107 R |
| 4,539,440 | 9/1985 | Sciarra | 179/107 |
| 4,742,887 | 5/1988 | Yamagishi | 181/129 |
| 4,777,474 | 10/1988 | Clayton | 340/539 |
| 4,790,019 | 12/1988 | Hueber | 381/68.4 |
| 4,869,339 | 9/1989 | Barton | 381/68.6 |
| 4,890,330 | 12/1989 | Meyer | 381/69.2 |
| 4,918,736 | 4/1990 | Bordewijk | 381/68 |
| 4,918,737 | 4/1990 | Luethi | 381/68.4 |
| 4,920,570 | 4/1990 | West et al. | 381/68 |
| 5,031,219 | 7/1991 | Ward et al. | 381/68 |
| 5,033,090 | 7/1991 | Weinrich | 381/93 |
| 5,172,346 | 12/1992 | Wagner et al. | 367/197 |

FOREIGN PATENT DOCUMENTS

3826294A1 8/1988 Germany .

OTHER PUBLICATIONS

*Science*, vol. 253, dated 05 Jul. 1991 Article entitled "Human Ultrasonic Speech Perception".

*Winston-Salem Journal*, dated 06 Jul. 1991 Article entitled "Research Holds New Hope for the Deaf".

*Primary Examiner*—Curtis Kuntz

*Assistant Examiner*—Sinh Tran

[57] ABSTRACT

A device is designed to provide persons with mild, moderate, severe, or profound hearing loss the ability to hear sound that would otherwise be inaudible as well as the ability to hear ambient environmental noise. The device is fabricated as: (1) a receiver assembly having a flexible coil shape worn in the outer portion of the auditory canal with a small transducer that extends into the auditory canal, and (2) a transmitter assembly having a microphone located remotely on the person, whereby information is transmitted to the receiver assembly via modulated carrier waves. The need for a battery in the receiver assembly is eliminated as the power supply is driven by magnetic induction from the transmitter assembly positioned a few inches away, as in a neck pendant.

19 Claims, 7 Drawing Sheets

HEARING AID DEVICE

This is a continuation-in-part of pending patent application Ser. No. 07/848,320 filed 09 Mar. 1992, now U.S. Pat. No. 5,343,532.

BACKGROUND OF THE INVENTION

1. Field of the Invention

The invention herein pertains to devices for assisting the hearing impaired and particularly to a device having an in-ear component and a remote microphone worn on the person.

2. Description of the Prior Art and Objectives of the Invention

One-piece prior art devices to assist the hearing impaired are usually worn in or about the ear and consist of a microphone that receives audible sound, an amplifier that amplifies the sound, and a transducer that delivers the sound to the user's ear. An in-ear molded plug device generally reduces the opportunity for perception of natural sound. Acoustic coupling between the microphone and the transducer results in squealing or feedback when the device is operated at the high amplification levels required for individuals with mild or greater hearing impairments. Prior in-ear devices require frequent and difficult battery replacement.

A typical molded hearing aid ear plug presents a significant restriction to the natural sounds of ambient environmental sound since it substantially closes the ear canal. Without regard to the degree of hearing loss an individual may suffer, the individual's ability to detect the direction of ambient sound is very important for proper sound sensing.

Also, conventional hearing aids are usually made to fit a particular wearer's ear and are not generally pliable, oftentimes causing discomfort and becoming loose during wear. Such hearing aids can also retain ear wax, causing a loss of performance and requiring frequent replacement and maintenance.

In view of the problems and disadvantages with known hearing aids, it is one objective of the present invention to provide a two (2) component hearing aid that includes: (1) a pliable ear receiver and (2) a wireless remote transmitter worn on the person.

It is another objective of the invention to provide an "in-ear" receiver that will not block ambient environmental sound from passing through the auditory canal, thereby enhancing the user's ability to detect the direction of ambient sound at greater distances.

It is still another objective of the invention to provide a small, lightweight transmitter that allows the user to adjust the gain of the received signal.

It is yet another objective of the invention to provide a feature in the form of a frequency change in the test tone of the transmitter if the transmitter battery becomes weak.

Various other objectives and advantages of the invention will become apparent to those skilled in the art as the more detailed presentation below is reviewed.

SUMMARY OF THE INVENTION

The hearing aid device of the invention allows the user to hear ambient environmental sounds while it amplifies those sounds that would normally be inaudible. This is accomplished by an in-ear component that allows a transducer to be placed in the ear canal but that leaves the auditory canal substantially unblocked. This invention is very beneficial in situations where the user needs to be alerted to impending danger signals, such as automobile horns or warning sirens, while allowing determination of the direction of such ambient environmental sounds, to the extent that the user is able. Use of the invention is not restricted to individuals with hearing impairments as it has applications in situations where an individual requires amplified sound from a particular source while maintaining an awareness of normal ambient environmental sounds.

The invention includes a microphone and a modulated carrier wave transmitter assembly that is remotely located from the ear but on the body of the user as a piece of jewelry or necklace, for example. Also included is a modulated carrier wave receiver assembly having a receiver, an amplifier, a transducer, and a flexible housing for wearing in the outer portion of the auditory canal.

DESCRIPTION OF THE PREFERRED EMBODIMENT

The transmitter assembly of the invention includes a microphone and transmitter that is remotely located on the person relative to the receiver assembly to reduce or eliminate the possibility of an undesirable acoustic coupling or feedback by virtue of acoustic losses resulting from the distance separating the microphone from the transducer in the receiver assembly.

In the case of a user with a hearing impairment in both ears, the transmitter assembly includes two (2) microphones and transmitters designed to be directional in their ability to detect audible sound. The transmitter assembly has controls that allow the user to adjust the amplitude of the received signal. In the case of a dual hearing aid system, the amplitudes are individually adjustable. Frequency response tailoring is also achieved in the transmitter assembly, which is powered by a nickel cadmium battery and includes a visual low battery indicator. Also included is a test mode, which transmits a tone of preset level and frequency to the apparatus worn in or near the ear of the user. A change in frequency and level of this tone warns the user of impending battery failure and resulting distortion of the audio output of the apparatus worn in or near the ear. Also included is a modulated carrier wave transmitter, of the type acceptable under Part 15 of the Federal Communications Commission Rules and Regulations for operation in the ultra high frequency spectrum, to significantly reduce or eliminate the possibility of interference from outside sources.

A second component of the invention consists of a receiver assembly designed to be worn in the outer end of the auditory canal with a transducer attached and extending into the auditory canal. The receiver assembly is a conically-shaped coil and is designed to be flexible so it can be manually compressed or expanded to fit the curvature of a particular wearer's auditory canal. The coil shape of the receiver assembly frictionally maintains the device in place inside a wearer's ear yet allows ambient sounds to pass through the open channel within the coil and into the wearer's inner ear. The receiver assembly is encased in a flexible polymeric housing having a relatively easily bendable wire of suitable diameter to provide structural strength. The transducer is encased in a small diameter tube attached to the receiver housing so it will not block the auditory canal. The receiver assembly is powered by DC voltage resulting from interaction with a magnetic field generated by the transmitting device.

The receiver assembly includes a receiver, amplifier, and transducer that are all enclosed in a thin, flexible plastic housing, which facilitates cleaning by the user.

The invention herein may also be used with a conventional bicross hearing aid (as is known in the industry) to help improve the hearing of those with only one healthy ear.

DETAILED DESCRIPTION OF THE DRAWINGS AND OPERATION OF THE INVENTION

Figure 1:
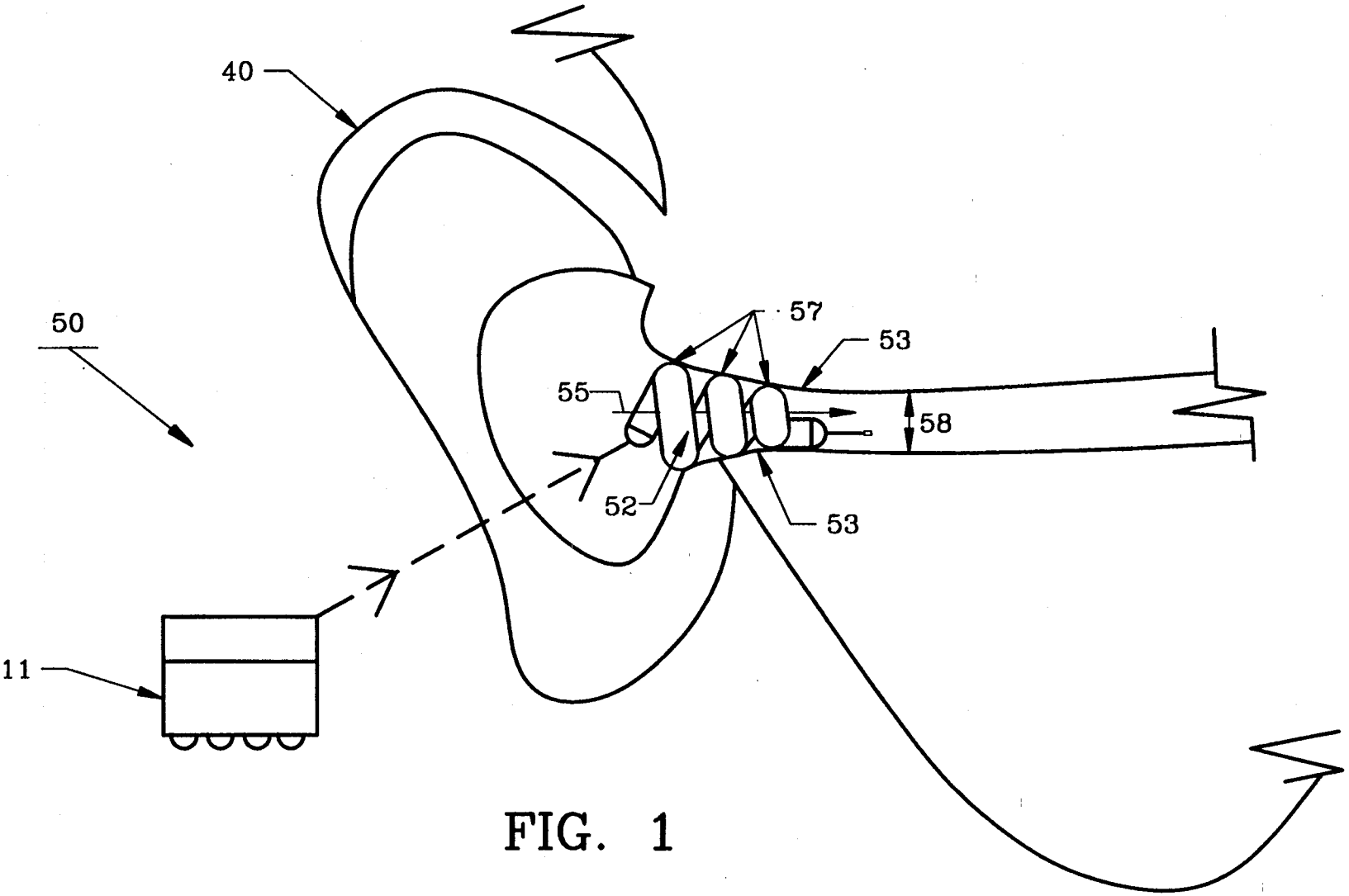
FIG. 1 demonstrates the coil-shaped receiver assembly of the invention positioned in a typical human auditory canal and the remote transmitter assembly nearby, as worn on the person.
Figure 2:
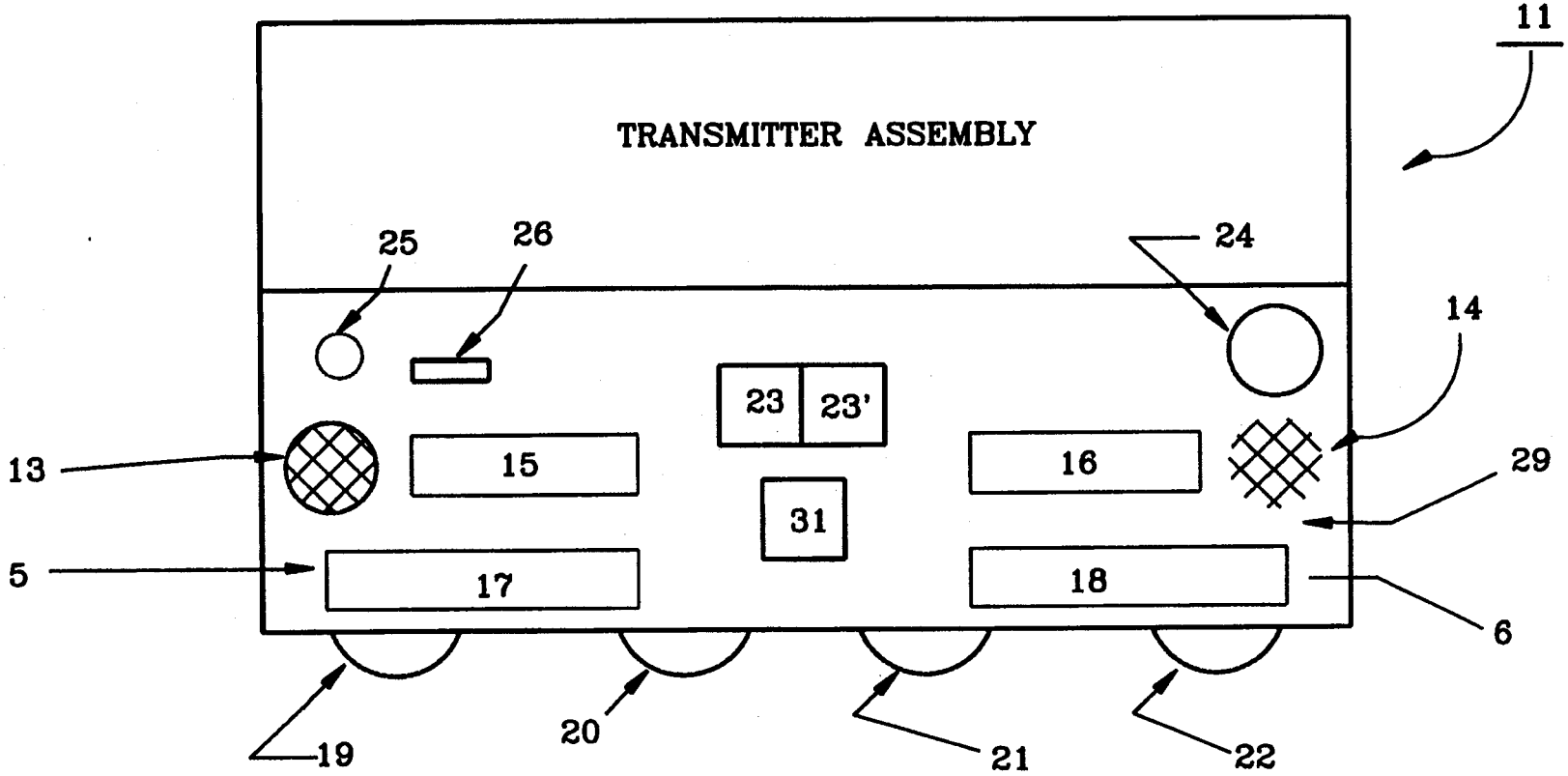
FIG. 2 illustrates a close-up view of the transmitter assembly of the invention.
Figure 5:
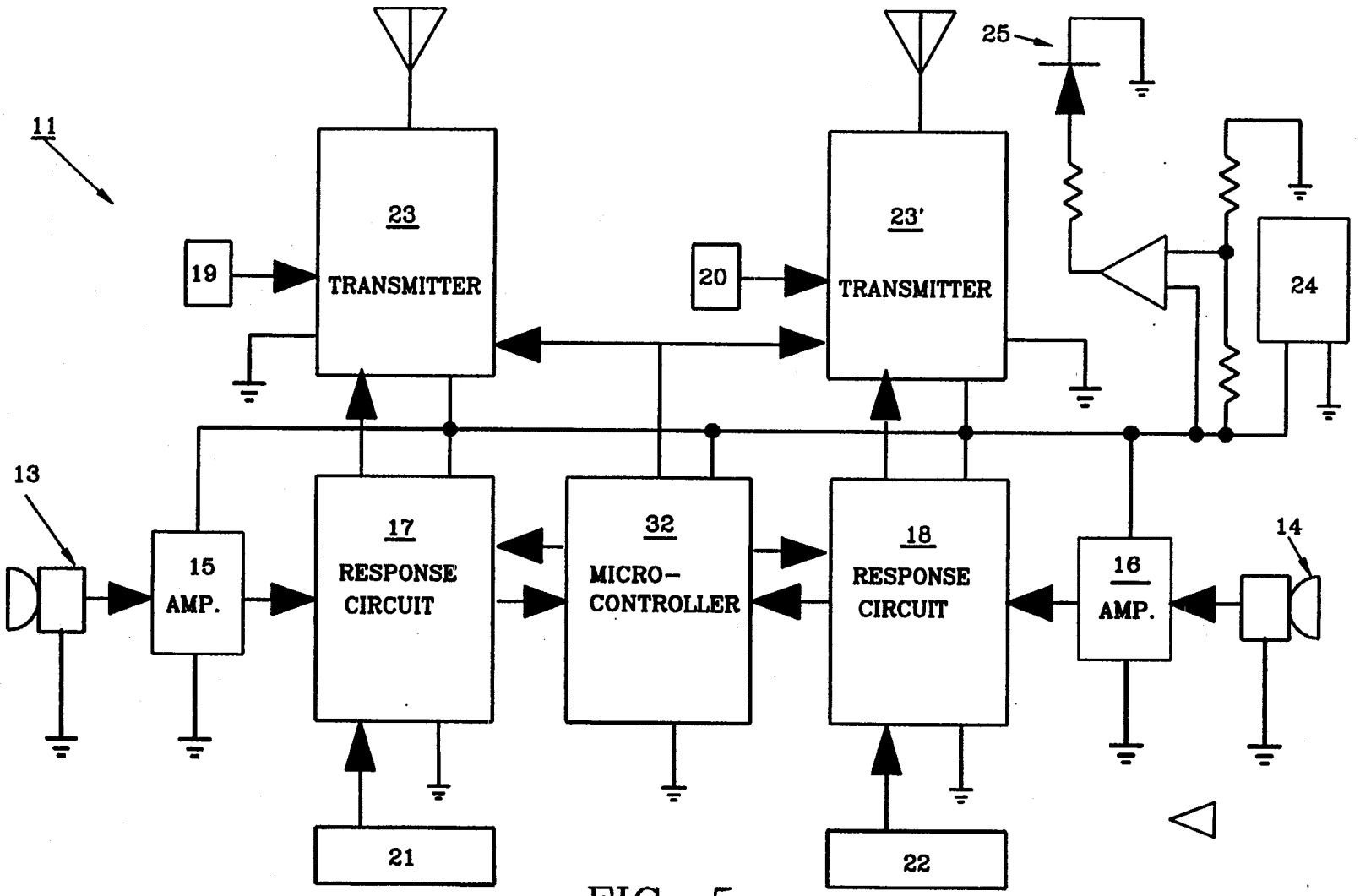
FIG. 5 shows circuitry of the transmitter assembly in block form.

For a more complete understanding of the invention and its operation, hearing device 50 is shown in FIG. 1 with transmitter assembly 11 positioned remotely from receiver assembly 52, which is in place in ear 40. Transmitter assembly 11 consists, as seen in FIGS. 2 and 5, of a left channel microphone 13 and a right channel microphone 14 for relaying audio information through circuitry (FIG. 5) to the left channel amplifier 15 and the right channel amplifier 16, respectively. These circuits in turn communicate with left channel level and frequency response circuit 17 and right channel level and frequency response circuit 18 and microcontroller 32. In circuits 17 and 18, the audio response is tailored to fit the individual user. Left channel gain control 19 and right channel gain control 20 are utilized to allow the user independent control of the gain of each channel. Likewise, left channel tone control 21 and right channel tone control 22 are utilized to allow the user independent control of the response characteristics of each channel. The output of level and frequency response circuits 17 and 18 are fed, respectively, to transmitters 23, 23'. In transmitters 23, 23', the channels are combined in a standard multiplexed frequency modulated carrier wave output.

Rechargeable battery 24 in transmitter assembly housing 29 (which may be formed from a durable plastic) drives assembly 11. An alternate means to drive assembly 11 may include magnetic induction. The condition of rechargeable battery 24 is monitored by a low battery indicator or comparator 25, which may be monitored or controlled by microcontroller 32. A spare battery can be kept in battery storage compartment 31, as also seen in FIG. 2.

Transmitter assembly 11 is designed to be worn on the person, perhaps as jewelry. For example, a neck pendant could house the transmitter circuitry with an attached necklace comprising the antenna. Dimensions may be aproximately 100×100×10 mm for transmitter assembly 11, but it could take the form of a personal accessory, such as a watch or pendant replica, and be made smaller. It is important that left channel microphone 13 and right channel microphone 14 be of a directional nature to improve the user's ability to sense direction with respect to the source of the audible sound received.

Figure 3:
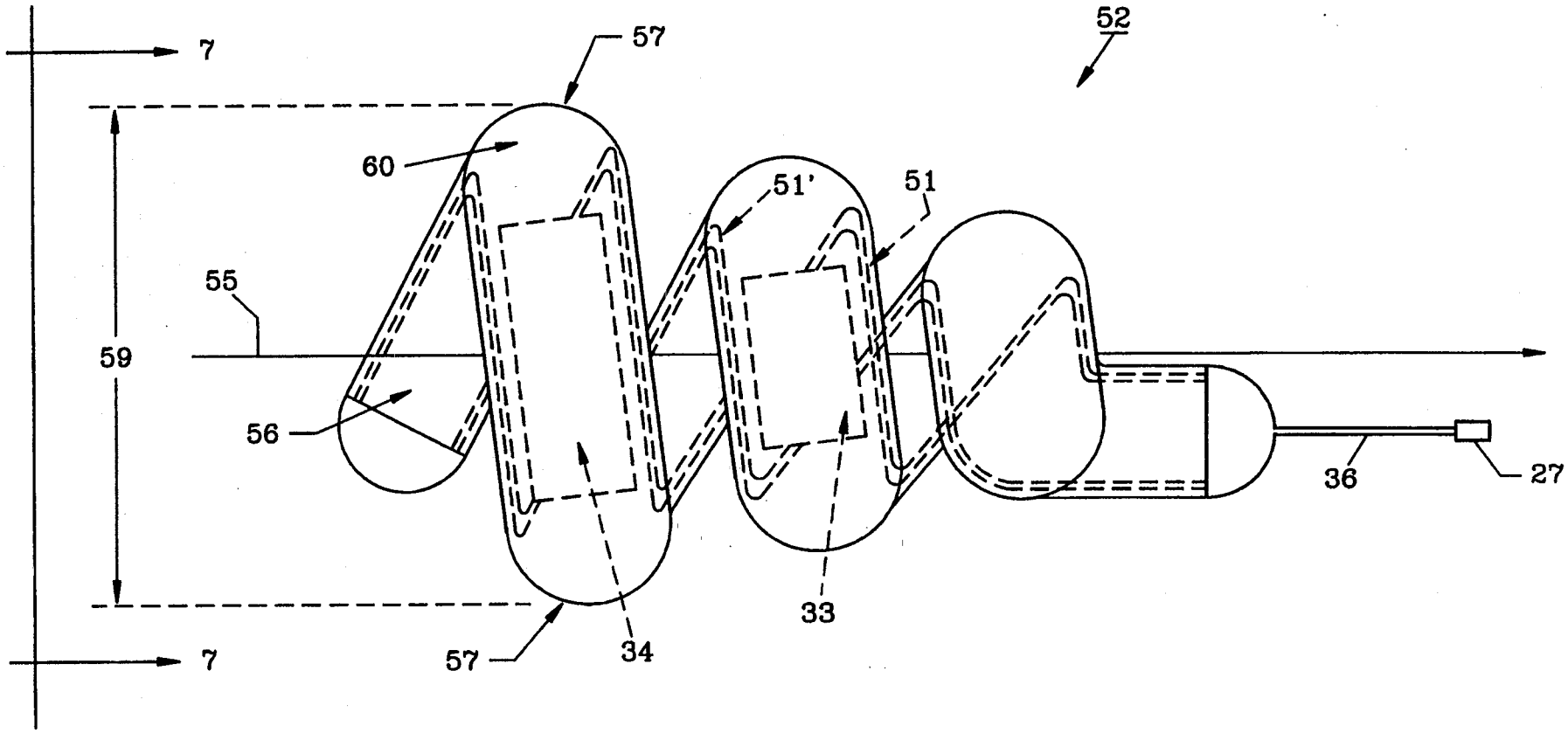
FIG. 3 depicts a close-up elevational side view of the coil-shaped receiver assembly of FIG. 1 removed from the ear.
Figure 7:
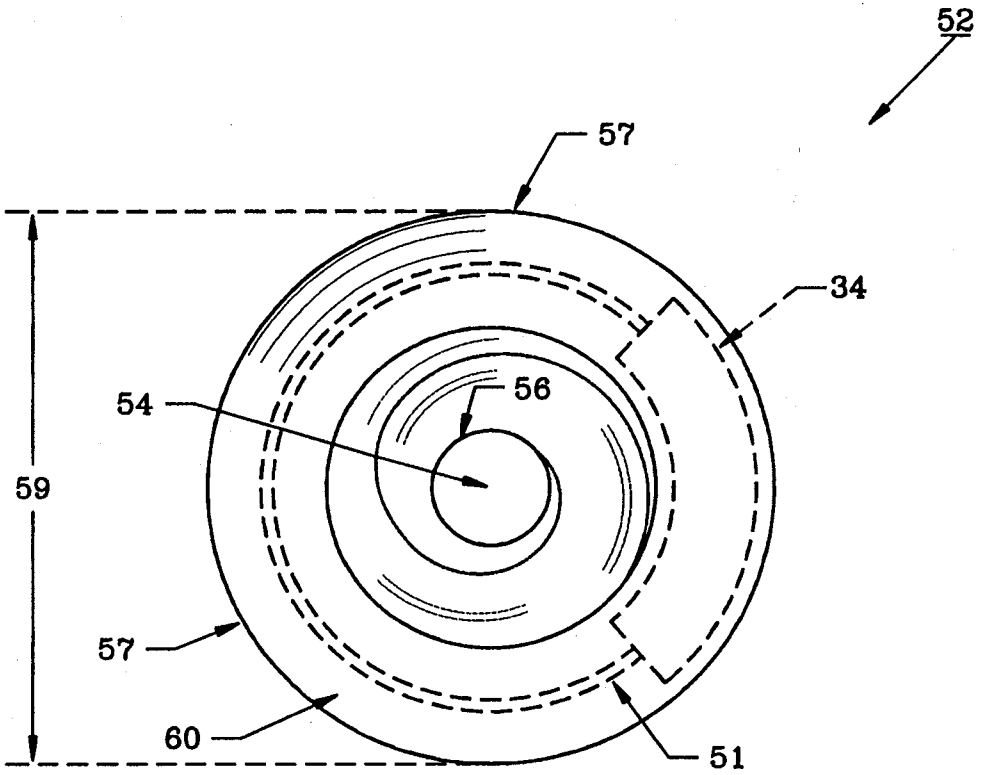
FIG. 7 depicts a close-up elevational end view of the coil-shaped receiver assembly seen in FIG. 3.

As shown in FIG. 3, receiver assembly 52 is a conical coil construction with a flexible polymeric housing 60 composed of, for example, polyvinyl chloride or other suitable material, which allows receiver assembly 52 to be compressed or expanded to the diameter 58 and curvature of the user's auditory canal 53, as shown in FIG. 1. Receiver assembly 52 can be compressed or expanded to generally conform diameter 59 of receiver assembly 52 to diameter 58 of auditory canal 53 so that certain of outer coil edges 57 contact the walls of the wearer's auditory canal 53 to hold receiver assembly 52 comfortably in place. While shown in FIG. 3 as having three coils, receiver assembly 52 could also be made with any desirable number of coils. As illustrated in FIG. 7, inner coil edges 56 define channel 54 through which ambient environmental sound (depicted by arrow 55 in FIG. 3 ) can travel uninhibited. Bendable wires 51, 51' are embedded in flexible polymeric housing 60, as required, to maintain the desired shape upon compressing or expanding. Wires 51, 51' provide structural strength and may be formed from steel, aluminum, or certain plastics.

Figure 4:
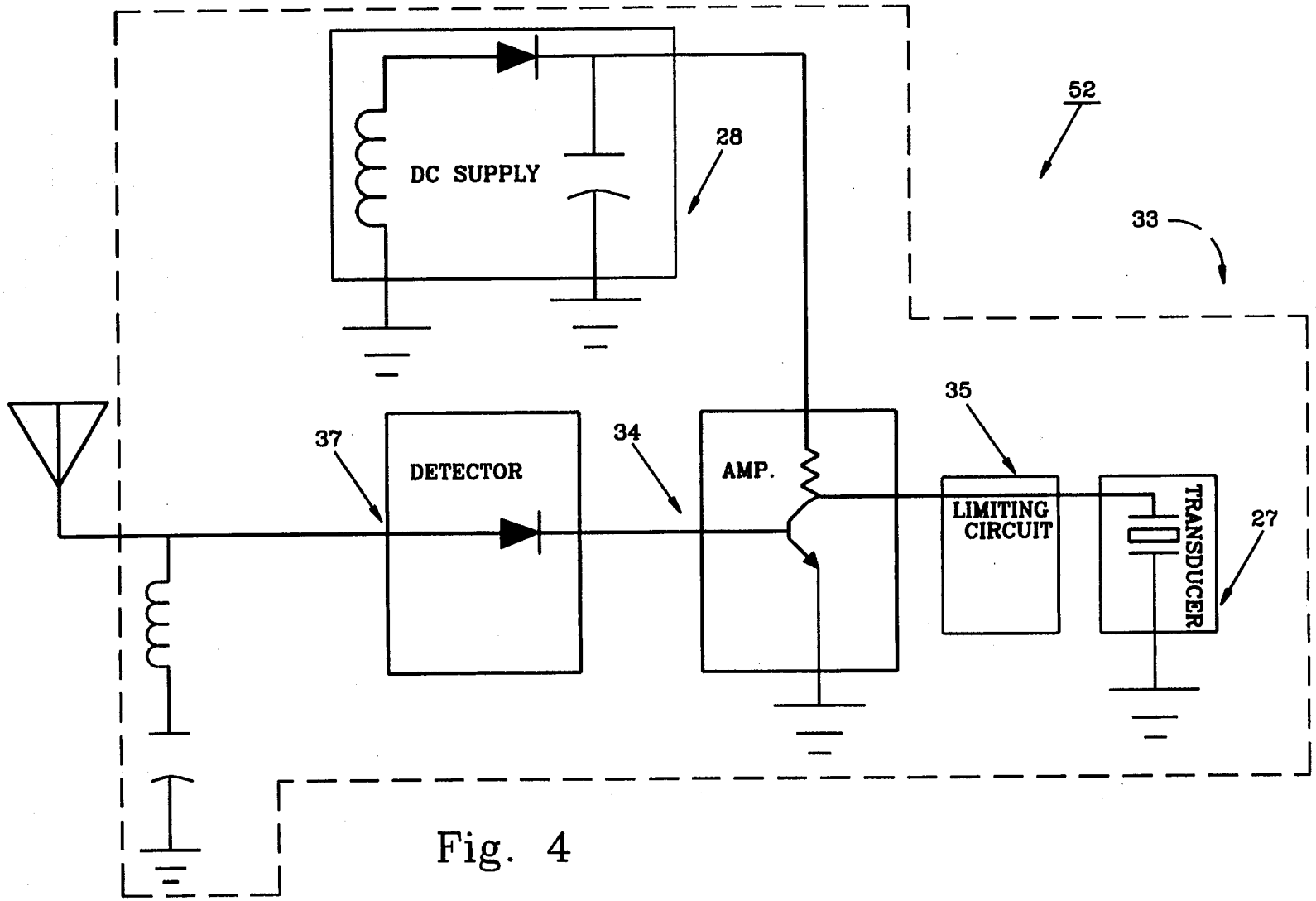
FIG. 4 demonstrates circuitry of the receiver assembly in block form.

Receiver assembly 52, as seen in FIG. 4, includes receiver 33 that is designed to intercept and demodulate the multiplexed frequency modulated signal from transmitter assembly 11. Receiver assembly 52 is designed to demodulate either the right or left channel information. A received signal is sent to amplifier 34 that provides the required level to drive transducer 27. Conventional limiting circuit 35 is included to reduce the possibility of hearing damage resulting from an unexpected loud impulse (noise). Transducer 27 is affixed on flexible stem 36 so that the location of transducer 27 in the auditory canal can be adjusted by bending stem 36. DC supply 28 (FIG. 4) is driven by magnetic induction, which eliminates the need for a battery in receiver assembly 52. Detector 37 allows only frequency specific signals to pass to amplifier 34, as detector 37 comprises a tuned diode. Receiver assembly 52 may be activated by transmitter assembly 11 housed within a pendant worn around the neck, whereby only a few inches (6–10) separate transmitter assembly 11 from receiver assembly 52.

Figure 6:
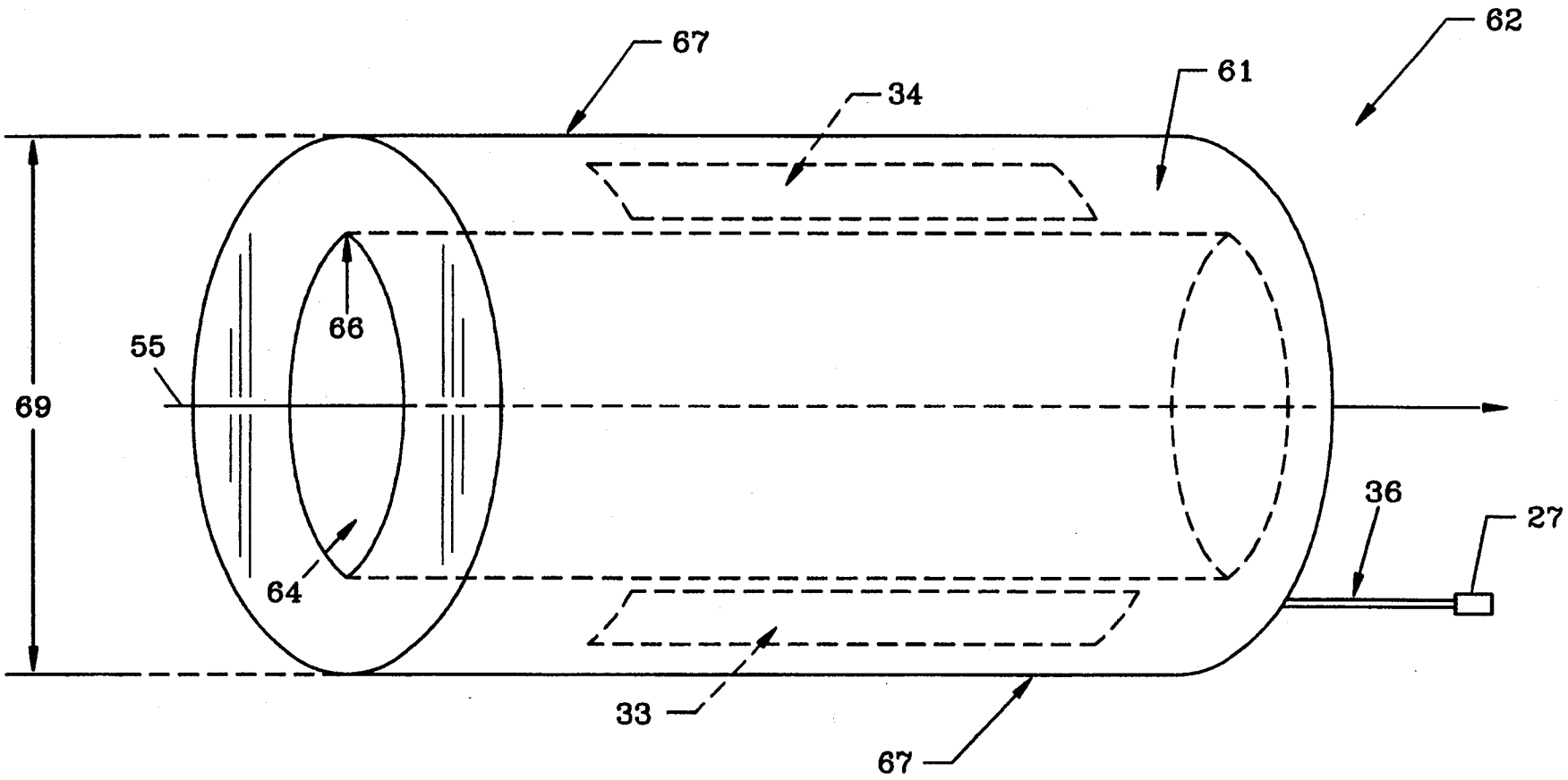
FIG. 6 shows another embodiment of the receiver assembly in the shape of a hollow tube.

FIG. 6 depicts a hollow tube-shaped embodiment of receiver assembly 62 having the same internal components, receiver 33 and amplifier 34, as embodiment 52. Receiver assembly 62 has inner walls 66 that define aperture 64 through which ambient environmental sound (depicted by arrow 55) can travel uninhibited. Outer diameter 69 is approximately the same diameter as that of a wearer's auditory canal so that outer walls 67 contact the walls of the auditory canal to hold receiver assembly 62 in place. Receiver assembly 62 may also be constructed with a flexible polymeric housing 61. Transducer 27, affixed to flexible stem 36, is also present in this embodiment.

All circuitry for receiver assembly 52 and receiver assembly 62 is manufactured on conventional thin flexible printed circuit stock to allow the unit to be easily shaped by manual pressure to conform to the user's outer auditory canal area. Values for the particular circuit components are matched, as would be understood by those skilled in the art, for the most convenience, cost efficiency, and operating efficiency.

The illustrations and examples provided herein are for explanatory purposes and are not intended to limit the scope of the appended claims.

I claim:

1. A hearing aid device comprising a receiver assembly, said receiver assembly comprising a housing, and a transducer, said transducer attached to said housing, said receiver assembly positionable in the outer portion of a wearer's auditory canal with the transducer extending into the auditory canal, said housing defining a large, linear central channel wherein the auditory canal is substantially open and unblocked to allow environmental sounds to pass uninhibited through said housing.

2. The hearing aid device of claim 1 wherein said receiver assembly is coil-shaped.

3. The hearing aid device of claim 2 wherein said receiver assembly further comprises outer coil edges, said outer coil edges for contacting the walls of the wearer's auditory canal.

4. The hearing aid device of claim 2 wherein said receiver assembly further comprises inner coil edges, said inner coil edges defining said channel through which ambient environmental sound can pass uninhibited.

5. The hearing aid device of claim 3 and including a limiting circuit, said limiting circuit to limit the effect and damage of a sudden, loud noise, said limiting circuit connected to said receiver.

6. The hearing aid device of claim 1 wherein said receiver assembly further comprises a receiver, said receiver comprising an amplifier.

7. The hearing aid device of claim 3 and including a power source, said power source being responsive to magnetic induction, said power source connected to said amplifier.

8. The hearing aid device of claim 1 and including a transmitter assembly, said transmitter assembly for detecting audible sounds, said transmitter assembly in remote communication with said receiver assembly.

9. The hearing aid device of claim 6 wherein said transmitter assembly comprises a microphone, said microphone an amplifier in communication with said amplifier, a transmitter, said amplifier connected to said transmitter, and a frequency reponse circuit, said frequency response circuit connected to said amplifier, wherein sounds detected by said microphone are transmitted by said transmitter to said receiver assembly.

10. The hearing aid device of claim 7 and including left and right gain controls, said left and right gain controls connected to said frequency response circuit.

11. The hearing aid device of claim 6, including a transmitter assembly housing and a spare battery storage compartment, said spare battery storage compartment positioned within said transmitter assembly housing.

12. The hearing aid device of claim 8 wherein said transmitter assembly comprises: a transmitter a left microphone, a left amplifier, a left frequency response circuit, a right microphone, a right amplifier, and a right frequency response circuit, said left microphone, said left amplifier, said left frequency response circuit, said right microphone, said right amplifier, and said right frequency response circuit all connected to said transmitter.

13. The hearing aid device of claim 1 wherein said receiver assembly is tube-shaped.

14. The hearing aid device of claim 1 and including a bendable wire, said bendable wire embedded in said housing.

15. The hearing aid device of claim 1 wherein said receiver assembly is conically shaped.

16. A hearing aid comprising: a coil-shaped signal receiver assembly, said coil-shaped signal receiver assembly including a flexible housing and a transducer, said transducer attached to said flexible housing, said coil-shaped signal receiver assembly positionable in the outer portion of the auditory canal of a wearer with said transducer extending into the auditory canal, said flexible housing defining a large, linear central channel, said channel for leaving the auditory canal substantially open to allow environmental sounds to pass uninhibited through said housing into the auditory canal.

17. The hearing aid as claimed in claim 16 and including a bendable wire, said bendable wire embedded in said flexible housing.

18. A hearing aid device comprising in combination:

(a) a transmitter assembly, said transmitter assembly for detecting audible sounds; and (b) a coil-shaped receiver assembly, said coil-shaped receiver assembly in remote communication with said transmitter assembly, said coil-shaped receiver assembly comprising a transducer and a flexible housing, said transducer attached to said flexible housing, said flexible housing defining a large, linear central channel, said coil-shaped receiver assembly positioning in the outer portion of a wearer's auditory canal with said transducer extending into the auditory canal, said channel for leaving the auditory canal substantially open and unblocked to allow environmental sounds to pass uninhibited through said housing into the auditory canal.

19. The hearing aid device of claim 19 wherein said coil-shaped receiver assembly further comprises a bendable wire, said bendable wire embedded within said flexible housing.

* * * * *